US006211851B1

(12) United States Patent
Lien et al.

(10) Patent No.: US 6,211,851 B1
(45) Date of Patent: Apr. 3, 2001

(54) METHOD AND APPARATUS FOR ELIMINATING CROSSTALK IN ACTIVE MATRIX LIQUID CRYSTAL DISPLAYS

(75) Inventors: Shui-Chih Alan Lien, Briarcliff Manor; Frank Robert Libsch, White Plains, both of NY (US)

(73) Assignee: International Business Machines Corporation, Armonk, NY (US)

( * ) Notice: Subject to any disclaimer, the term of this patent is extended or adjusted under 35 U.S.C. 154(b) by 0 days.

(21) Appl. No.: 09/311,004

(22) Filed: May 13, 1999

Related U.S. Application Data

(60) Division of application No. 08/528,168, filed on Sep. 14, 1995, which is a continuation-in-part of application No. 08/056,170, filed on Apr. 30, 1993, now abandoned.

(51) Int. Cl.[7] ..... G09G 3/36

(52) U.S. Cl. ..... 345/89; 345/58

(58) Field of Search ..... 345/87, 92, 94, 345/96, 97, 55, 58, 89, 90, 95, 99, 50; 349/33, 36, 37, 42, 41, 54

(56) References Cited

U.S. PATENT DOCUMENTS 4,845,482 * 7/1989 Howard et al. ..... 345/94
5,583,533 * 12/1996 Moriyama ..... 345/94

* cited by examiner

*Primary Examiner*—Chanh Nguyen
(74) *Attorney, Agent, or Firm*—David Aker

(57) ABSTRACT

The elimination of crosstalk between data lines and pixel cells in a thin film transistor/liquid crystal display is accomplished by applying a precharge voltage level for a given data signal level which also provides an equivalent to a compensation voltage for a prior scan line to a given data line for a time period less than the standard scan line period of the display, and applying the data signal to the given data line for the remainder of the scan line period.

14 Claims, 7 Drawing Sheets

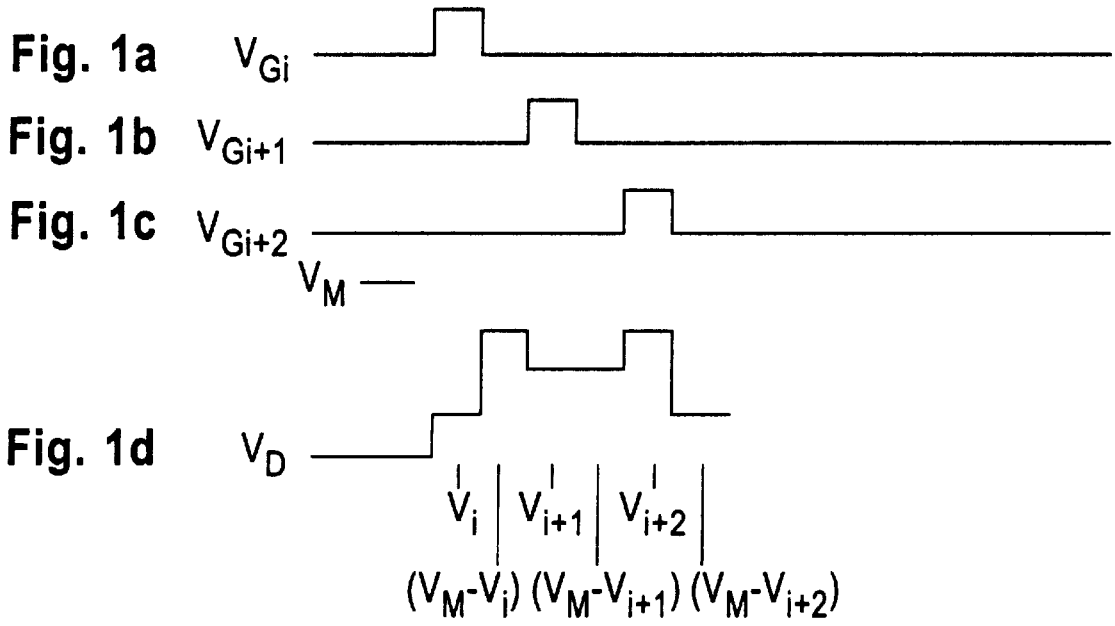
(PRIOR ART)

Gate Lines
Data Lines
$G_1$
$G_2$
$G_{i-1}$
$G_i$
$G_{i+1}$
$+V_m$
0
$-V_m$
$-V_m+V_N$
$V_1$
$-V_2$
$V_m-V_1$
$V_m-V_{i-2}$
$-V_{i-1}$
$-V_m+V_{i-1}$
$V_i$
$V_m-V_i$
$-V_{i+1}$
$-V_m+V_{i+2}$
$V_{i+1}$
$V_{N-1}$
$V_m-V_{N-1}$
$-V_N$
$-V_m+V_N$
$-V_1$
$-V_m+V_1$
$V_2$
$-V_m+V_{i-2}$
$V_{i-1}$
$V_m-V_{i-1}$
$-V_i$
$-V_m+V_{i-1}$
$V_{i+1}$ G1
G2
Gi-1
Gi
Gi+1
Gate Lines
+Vm
0
-VN
Data Lines $G_1$
$G_2$
$G_{i-1}$
$G_i$
$G_{i+1}$
Gate Lines $+V_m$
0
$-V_N$
Data Lines $-V_m+V_N$
$V_1$
$V_m-V_1$
$-V_i$
$V_m-V_{i-2}$
$V_{i-1}$
$V_m-V_{i-1}$
$V_i$
$V_m-V_i$
$V_{i+1}$
$V_N$
$V_m-V_N$
$V_1$
$-V_m+V_1$
$V_2$
$-V_m+V_{i-2}$
$-V_{i-1}$
$-V_m+V_{i-1}$
$V_i$
$-V_m+V_i$
$-V_{i+1}$

METHOD AND APPARATUS FOR ELIMINATING CROSSTALK IN ACTIVE MATRIX LIQUID CRYSTAL DISPLAYS

RELATED APPLICATIONS

This is a divisional application of U.S. patent application Ser. No. 08/528,168, filed Sep. 14, 1995 which in turn is a continuation-in-part of Ser. No. 08/056,170 filed Apr. 30, 1993, now abandoned.

BACKGROUND OF THE INVENTION

1. Field of the Invention the present invention is generally directed to a method and apparatus for eliminating cross-talk in liquid crystal display devices. More particularly, the present invention is related to a display device in which means for preventing cross-talk between data lines and pixels is provided.

2. Background Art

As explained in U.S. Pat. No. 4,873,516 to Castleberry, a proper understanding of the present invention can only be had by understanding the operation of a liquid crystal display device and the problems of parasitic capacitance inherent in the structure of these devices. In particular, a liquid crystal display device typically includes a pair of substrates fixed a specified distance apart. This distance is typically approximately 6 microns. A liquid crystal material is disposed between the substrates. The substrates are selected so that at least one of them is transparent. If back lighting is provided as a means for providing or enhancing the display and image, it is required that both substrates be substantially transparent. On one of these substrates there is disposed a transparent ground plane conductor typically comprising material such as indium tin oxide (ITO). The opposing substrate contains a rectangular array of individual electrode elements, called pixel electrodes. A semiconductor switch (preferably a thin film transistor) is associated with each of these pixel electrodes and is typically disposed on the substrate containing these electrodes. These transistor switches are usually based upon either amorphous silicon or polycrystalline silicon technology. At present, amorphous silicon technology is preferred because of its lower process temperature requirements. In effect, the aforementioned structure results in a rectangular array of capacitor-like circuit elements in which liquid crystal material acts as a dielectric. Application of voltage to a pixel electrode results in an electro-optical transformation of the liquid crystal material. This transformation is the basis for the display of text or graphical information seen on the device. It is noted that the invention herein is particularly applicable to the above-described display device in that each of the pixel electrodes is associated with its own semiconductor switch which may be turned on or off so that each individual pixel element may be controlled by signals supplied to its associated semiconductor switch. These semiconductor devices essentially act as electron valves for the deposition of charge on individual pixel electrodes.

Each transistor is provided with a scan line signal and a data line signal. In general, there are M data lines and N scan lines. Typically, the gate of each transistor switch is connected to a scan line and the source or drain of the transistor switch is connected to a data line.

In operation, a signal level is established on each of the M data lines. At this point, one of the N scan lines is activated so that the voltages appearing on the data lines is applied to the pixel electrodes through their respective semiconductor switch elements. A necessary consequence of the arrangement described is that each pixel electrode is surrounded on both sides by data lines. One of the data lines is the data line associated with the pixel electrode. However, the other data line is associated with an adjacent pixel electrode. This latter data line carries a different information signal. Also inherent in this structure are certain capacitive features. In particular, the pixel electrode and its opposing ground plane electrode portion form a capacitive structure. In addition, there are parasitic capacitances between each data line, and its surrounding pixel electrode elements. Moreover, there is a parasitic capacitance which exists between the source and drain of the semiconductor switch element. The parasitic capacitances permit undesired signals to be applied to the pixel electrodes.

In a typical operational sequence, desired voltage levels are established on the data lines and a scan line is activated so as to apply these voltages to a single row of pixel electrodes. After a time sufficient for charging the liquid crystal capacitor, a different scan line is activated and a different set of data voltages is applied to a different pixel row. Typically, an adjacent pixel row is selected for writing video information. Thus, in a typical operation, one row of the display device can be written at one time, from the top to the bottom of the screen. In television applications, this top to bottom writing occurs in approximately 1/30th or 1/60th of a second. Thus, in this time period, a complete image is displayed on the screen. This image may include both text and graphical information.

As is well known in the electrical arts, capacitive effects are generally proportional to area and inversely proportional to distance. Thus, in high resolution liquid crystal display devices, the parasitic capacitance effects are particularly undesirable because of the requirement for small spacing between the data lines and the pixel electrode. In typical applications contemplated herein, such as a television or computer display environment, the pixel electrodes are approximately 300×100 microns$^2$ and separated by a space of approximately 6 microns with an area of approximately 10×10 microns$^2$ being set aside from each pixel for the placement of its associated semiconductor switch element. Thus, it is found that in high resolution thin film transistor matrix addressed liquid crystal displays, the parasitic capacitance between the data lines and the pixel electrode is not insignificant when compared to the pixel capacitance. It is also noted that the parasitic capacitance between the data lines and the pixel electrode is increased by the presence of the parasitic source to drain capacitance in the switch element itself. In operation of such a display, the voltage on a pixel is set during its row address time. The semiconductor switch is then turned off and the voltage should remain fixed until the display is refreshed. However, any change in the voltage on an adjacent data line produces a change in the voltage on the pixel. In many drive schemes, the voltage on a data line typically varies between 0 and 5 volts, depending on how many elements in the column are turned on. This results in an uncertainty or cross-talk in the voltage on the pixel. In a design in which there are approximately 100 pixels per inch, this results in a maximum voltage error of approximately 0.2 volts RMS. While this is not critical for on-off displays, it is very significant for gray scale displays where changes in the voltage of 0.05 volts RMS are visible.

One method for reducing, but not eliminating cross-talk of the kind discussed above is the use of a storage capacitor in parallel with $C_{LC}$. This reduces the maximum error voltage. This method is commonly used at present but is undesirable, because it usually requires additional processing steps, because it can cause additional defects to be present and because it reduces the active area of the pixel elements.

Another method for eliminating crosstalk is described in U.S. Pat. No. 4,845,482 to Howard and Alt. Typical waveforms of this method are shown in FIG. 1(*a*) to FIG. 1(*d*). FIG. 1(*a*), FIG. 1(*b*) and FIG. 1(*c*) are waveforms applied to successive gate lines while FIG. 1(*d*) is a typical data line signal. The elimination of crosstalk is accomplished by providing the data complement for each data when the gate line is inactive. It is clear that this method requires that a fraction of the line time (typically one half) be devoted to the compensation signals, with the transistors turned off. As a result, it demands a factor of two increase in switching speed which requires faster switching TFTs, more expensive drivers, and higher power consumption to drive the data lines.

SUMMARY OF THE INVENTION

It is a principle object of the invention to provide a liquid crystal display and a method of operating the display wherein crosstalk is reduced or eliminated.

It is a further object of the invention to provide a circuit for driving the pixels of a liquid crystal display which utilizes the method.

It is another object of the invention to reduce crosstalk in a liquid crystal display without increasing the cost or power required to drive the pixels.

In accordance with the invention, in a liquid crystal display including a plurality of sequencially excited gate lines and a plurality of data lines the method for eliminating crosstalk between display elements comprises the step of exciting each data line for a time equal to a gate period so that changes in polarity of the data occurs during the first portion of the gate period (known as precharging). During a scan line time the first portion of the data signal has two purposes: (1) provide a compensation level for the previous data signal and (2) provide the precharge level for the upcoming data level. The second portion of the scan data signal provides the actual data voltage level.

Further, in accordance with the invention, in a liquid crystal display including a plurality of sequencially excited gate lines and a plurality of data lines crosstalk is eliminated by starting the gate time at a change in polarity of the data signal and ending the gate time before the next successive change in polarity of the data signal. When polarity of the data signal is changed the display elements to receive the data are precharged. The precharge may include a compensation level of equal magnitude and opposite polarity to the previous data level. After precharging the data signal is changed to its intended level.

Further, in accordance with the invention crosstalk between display elements is eliminated by alternating the polarity of the data voltage supplied to the data lines for every adjacent row; precharging the display elements to compensate for previous data during a first portion of a line time; and charging the display elements to a final, intended value during at least a portion of the remainder of the line time.

Also in accordance with the invention a display including a matrix of thin film transistor liquid crystal display cells driven by gate lines and data lines comprises gate signal means for applying a gate signal to successive ones of said gate lines for a gate signal period; and data signal means for applying to said data lines a data signal equal to a crosstalk compensation voltage minus data signal voltage for a previous gate signal period during a first portion of a current gate signal period, and for applying a voltage equal to a current data signal voltage for said current gate signal period to said data lines for a remainder of said current gate signal period.

BRIEF DESCRIPTION OF THE DRAWINGS

FIG. 1*a* to FIG. 1*d* represent timing diagrams for a prior art driving method.

DESCRIPTION OF THE PREFERRED EMBODIMENT

Figures 2A, 2B, 2C, 2D, 2E, 2F:
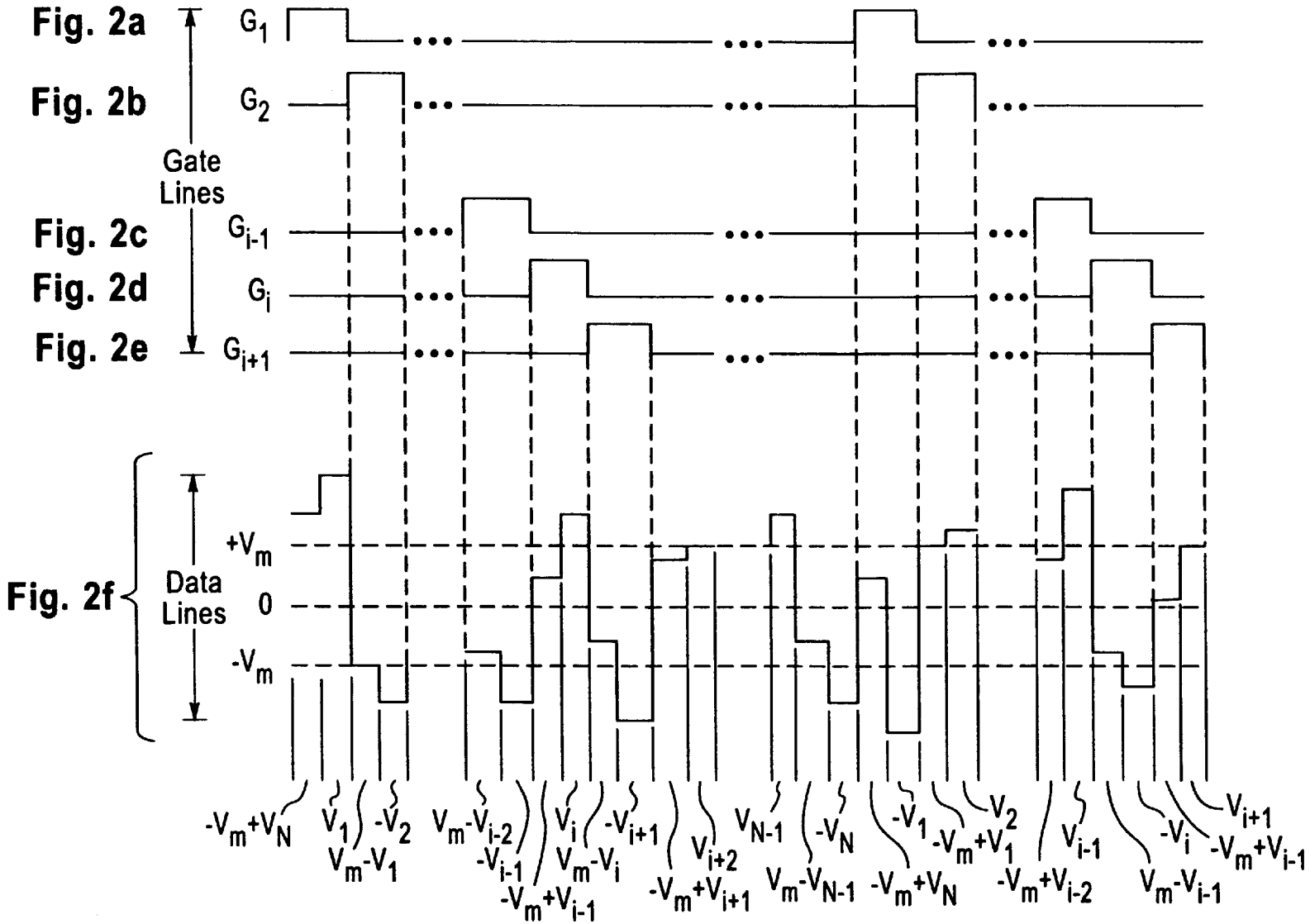
FIG. 2*a* to FIG. 2*f* represent timing diagrams for a first embodiment of the method according to the invention.

FIG. 2(*a*), to FIG. 2(*c*), illustrate the waveforms applied to to successive gate lines. FIG. 2(*f*) illustrates the waveform applied to a data line. The polarity of the data voltage is alternated for every adjacent row, with N rows total. During the first half of the line time, the pixels are precharged to $-V_m+V_{i\ l}$ (or $V_m-V_{i-1}$), which is the compensation level or for the previous data voltage, $+V_{i+1}$ (or $-V_{i-1}$). During the second half of the line time, they are charged in the final voltage $+V_i$ (or $-V_i$), which is the present data voltage. Thus, the entire line time is utilized to charge pixels.

it is easy to calculate the RMS voltage at the liquid crystal resulting from the disclosed waveform, assuming a coupling factor $\alpha$ associated with the bypass capacitance; that is the capacitance that exists between the data line and the liquid crystal electrode. The expression for the RMS voltage at the ith row position is given by $$[V_i(\mathrm{RMS})]^2 = \frac{1}{2N}\left\{\sum_{j(even)>i}^{N}[[(1-\alpha)V_i-\alpha V_j]^2+[(1-\alpha)V_i+\alpha(-V_m+V_j)]^2]+\sum_{j(odd)>i}^{N}[[(1-\alpha)V_i+\alpha V_j]^2+[(1-\alpha)V_i+\alpha(V_m-V_j)]^2]+V_i^2+[(1-\alpha)V_i+\alpha(V_m-V_i)]^2+\sum_{j(even)>1}^{i-1}[[(1-\alpha)V_i+\alpha V_j]^2+[(1-\alpha)V_i+\alpha(V_m-V_j)]^2]+\sum_{j(odd)=1}^{i-1}[[(1-\alpha)V_i-\alpha V_j]^2+[(1-\alpha)V_i+\alpha(-V_m+V_j)]^2]\right\},$$

where we assume $V_i>0$ and i=odd integer. The expressions for the other cases ($V_i>0$ and i=even integer; $V_i<0$ and i=odd integer; $V_i<0$ and i=even integer) give similar results. Also, the effects of the decay of the voltage have been neglected for simplicity. They are easily added, and do not change the conclusions. It can be seen by expanding this expression that there is cancellation of terms linear in $\alpha$, which would normally be the dominant crosstalk terms. The expression then becomes $$[V_i(\mathrm{RMS})]^2 = (1-\alpha)^2 V_i^2 + \frac{\alpha^2}{2N}\left[\sum_{j=1}^{N} V_j^2 + \sum_{i=1}^{N}(V_m - V_j)^2\right]$$

The first term represents a small gain correction; the second term represents the second order crosstalk term proportional to $\alpha^2$. It is clear that the first order crosstalk term is eliminated.

These expressions include only the terms describing the coupling from the data line to the liquid crystal electrode. There is also a coupling from the adjacent data line, but this can be included in a straightforward way, with the same cancellation. In this regard see the above mentioned U.S. Pat. No. 4,845,482 to Howard and Alt, assigning a coupling coefficient $\beta$ for the adjacent data line, then there are additional second order corrections proportional to $\beta^2$ and $2\alpha\beta$. However, the first order terms linear in $\alpha$ and in $\beta$ all cancel out. In general, the above result indicates that to achieve first order crosstalk elimination, $V_m$ can be set to any practical value. For the TFT/LCD case, where the TFT is operating in the linear region exhibits negligible drain to source voltage drop, $V_m$ can be set to zero. This scheme ($V_m$=0) reduces the number of data driver voltage levels needed since the compensation voltage levels are equal to the data voltage levels. For other AM LCDs, such as MlM or diode configurations, there exits a bias drop from the data line across the switch to the liquid crystal capacitor. In these AM LCDs, $V_m$ should be chosen to eliminate directional dependent data voltage level charging, thus, avoiding a precharging level larger than the final data level. To achieves this, $V_m$ should be chosen such that $V_{data}$(largest)−$V_m \leqq V_{data}$(smallest).

Figure 3:
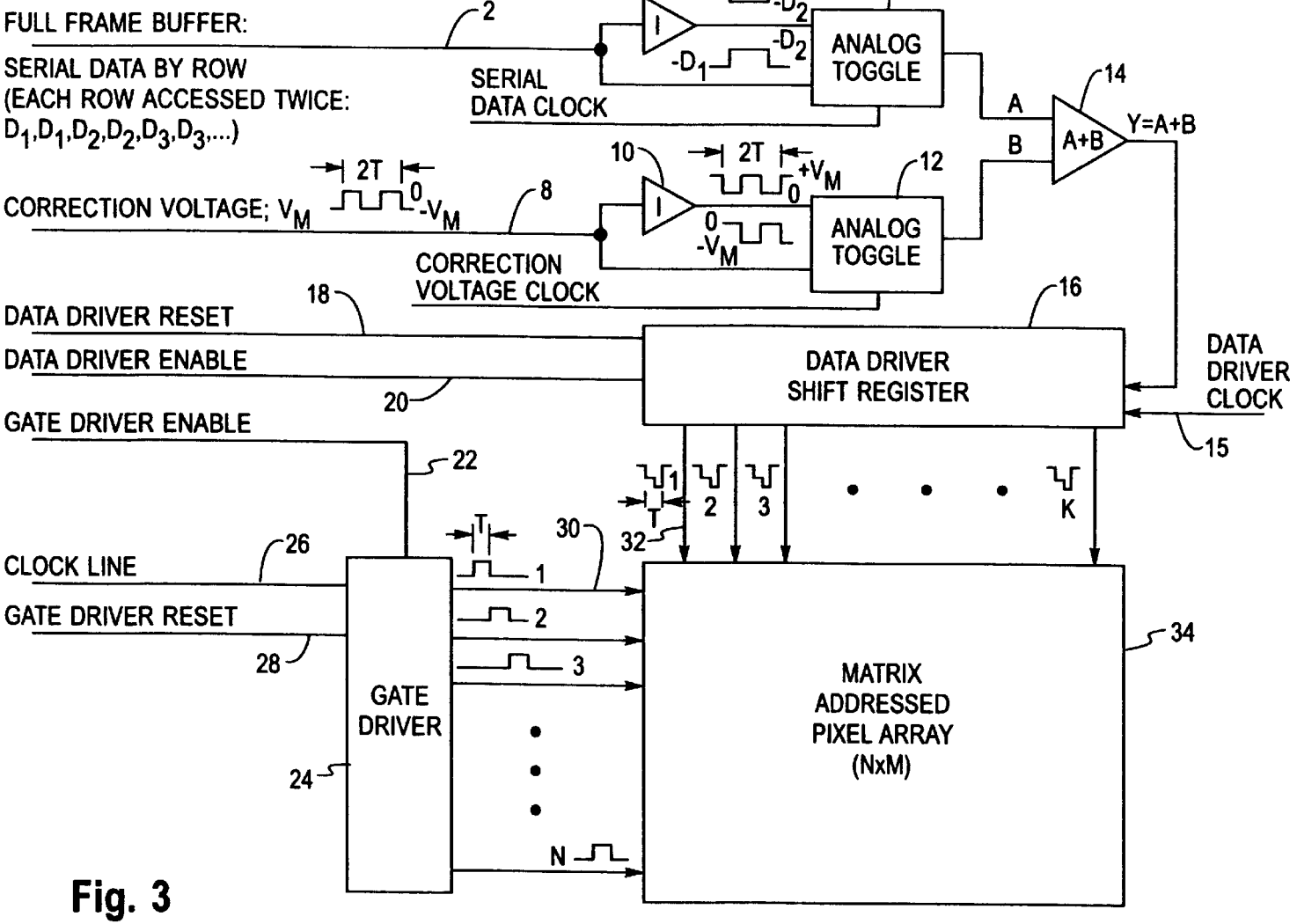
FIG. 3 is a block diagram for a circuit for implementing the invention in accordance with FIG. 2*a* to 2*f*.

FIG. 3 illustrates one analog addressing implementation, in accordance with the invention, for a multilevel grey scale matrix addressed pixel array 1. Serial data by row which for example could be provided from a frame buffer (not shown) is provided via data input line 2 to the first input of an analog toggle 4 and to the input of an inverter 6. The serial data on line 2 is provided twice so that the output of the toggle switch 4 is the serial signal A equal to D1,−D1,D2,−D2, D3,−D3, etc., where D1 represents the serial data V1 through VK at time t, where −D1 represents the serial data −V1 through VK at time t+T, D2 represents the serial data V1 through VK at time t+2T, etc.

The crosstalk correction voltage level is provided, for example, as a bilevel signal, alternating from zero to −VM, via line 8 to the second input of an analog toggle 12 and to the input of an inverter 10. The output of analog toggle 12 is the serial signal B equal to 0, Vm, 0, −Vm, 0, Vm, etc. The correction voltage clock of analog toggle 12 and the serial data clock of analog toggle 4 are synchronized so that the serial data B from the output of analog toggle 12 changes when serial data A from the output of analog toggle 4 changes in such a manner, for example, so that serial data A and serial data B to the inputs of a summer 14 will be D1 and zero, followed by −D1 and VM, followed by −D2 and zero, followed by D2 and −VM, etc.

The addition of serial data A and serial data B is accomplished by summer 14 in such a manner that the output Y will be the serial data D1, followed by (Vm−D1), followed by −D2, followed by (−Vm+D2), etc. A clock signal supplied on a data drive clock line 15 for a data driver shift register 16 will allow the data Y to be inputed in a serial fashion into the data driver shift register 16 at least K times faster then the parallel output 32, where K is equal to the number of data line outputs. A data driver reset line 18 and a data driver enable line 20 provide the syncronization between the Y serial data provided to shift register 16 and the parallel output on lines 32.

The gate driver enable line 22, clock line 26 and gate driver reset line 28 provide the syncronization between gate driver 24 and data driver shift register 16 so that the bilevel signal output from gate driver 24 (one of the gate lines 30 from 1' to N) is syncronized to the parallel output from the data driver shift register 16. For every gate driver output signal duration, represented by T, the data driver shift register parallel output (from 1 to M) is composed of the crosstalk compensation signal during a first portion of T and then followed by the unadulterated data signal (no compensation) during the remaining portion of T, as shown in the waveform timing diagram of FIG. 2(*f*).

Figures 4A, 4B, 4C, 4D, 4E, 4F:
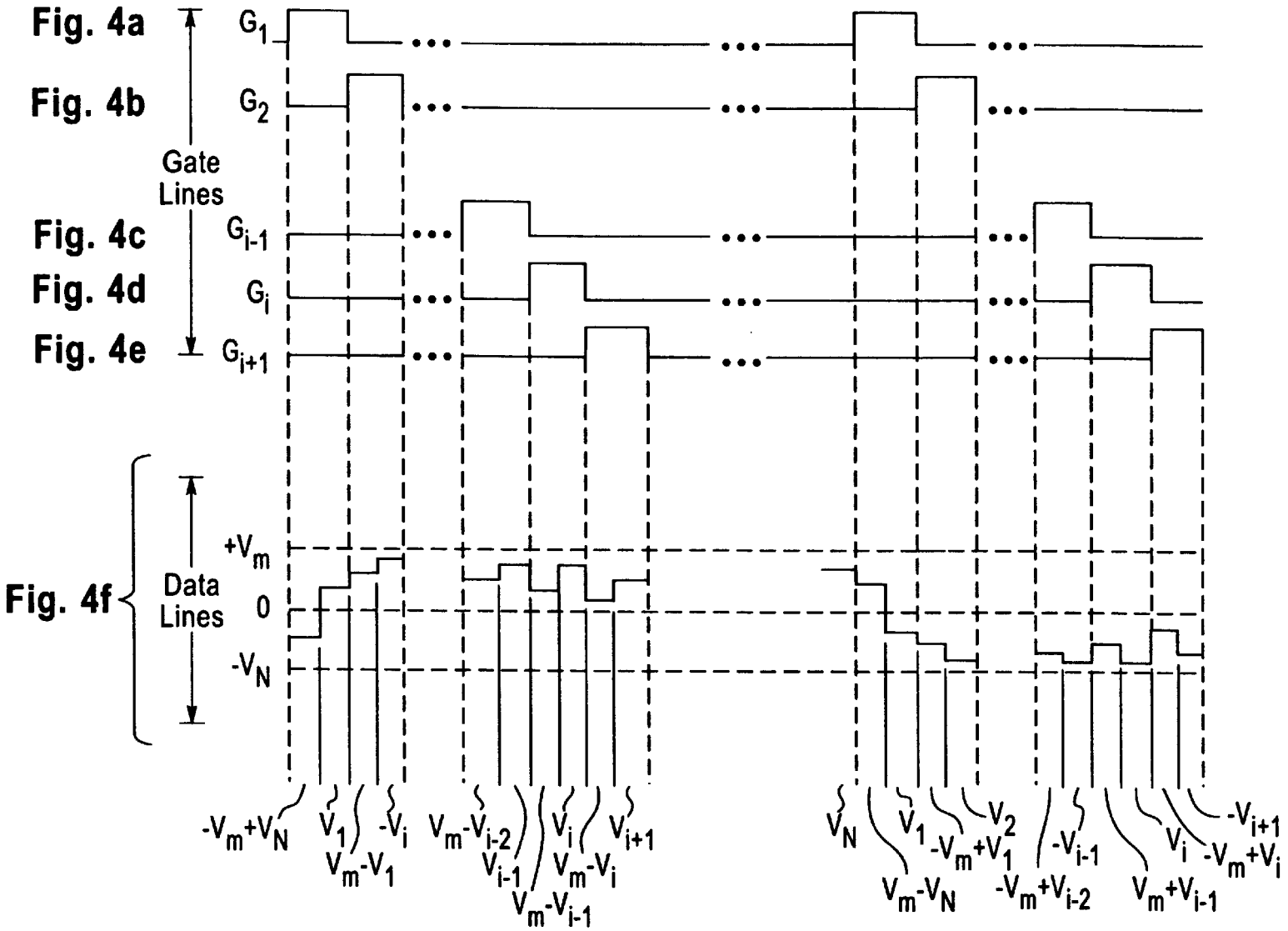
FIG. 4*a* to FIG. 4*f* represent timing diagrams for implementing another embodiment of the method according to the invention.

A second embodiment of the invention is shown in FIG. 4. The polarity of the data voltage is alternated for each frame. During the first half of the gate line time, the pixels are precharged to $V_m - V_{i-1}$(or $-V_m + V_{i-1}$), which is the compensated pulse for the previous data voltage, $V_{i-1}$(or $-V_{i-1}$). During the second half of the line time, they are charged to the final voltage $V_i$(or $-V_i$), which is the present data voltage. Thus, the entire line time is totally utilized to charge pixels. Also, the data voltage swing is only half of that of the previous embodiment shown in FIG. 2*a* to FIG. 2*f*. In a manner similar to that disclosed above, the RMS voltage at the liquid crystal resulting from the disclosed waveform is calculated, assuming a coupling factor $\alpha$ associated with the bypass capacitance.

The expression for the RMS voltage at the ith row position is given by $$[V_i(\mathrm{RMS})]^2 = \frac{1}{2N}\left\{\sum_{j=i}^{N}[[(1-\alpha)V_i + \alpha V_j]^2 + [(1-\alpha)V_i + \alpha(V_m - V_j)]^2] + \sum_{j=1}^{i-1}[[(1-\alpha)V_i - \alpha V_j]^2 + [(1-\alpha)V_i + \alpha(-V_m + V_j)]^2]\right\}.$$

Again, the effects of the decay of the voltage have been neglected for simplicity. They are easily added, and do not change the conclusions. It can be seen by expanding this expression that there is cancellation of terms linear in $\alpha$, which would normally be the dominant crosstalk terms. The expression then becomes $$[V_i(\mathrm{RMS})]^2 = (1-\alpha)^2 V_i^2 + \left(\frac{N+2-2i}{N}\right)\alpha(1-\alpha)V_i V_m + \frac{\alpha^2}{2N}\left[\sum_{j=1}^{N} V_j^2 + \sum_{j=1}^{N}(V_m - V_j)^2\right]$$

The first term represents a small gain correction. The second term is a correction which varies smoothly from top to bottom. The third term represents the second order crosstalk term proportional to $\alpha^2$.

Thus, advantageously, the entire scanning time is used to charge pixels. However, also of great advantage, the data voltage swing is only half of that of of the previous embodiment. This results in additional power savings, because display drivers having smaller dynamic response may be used.

A consequence of the implementation of the invention illustrated in FIG. 4*a* to FIG. 4*f* is that the change in polarity of the data signal voltage does not occur precisely at the end of a frame. Instead, the data voltage switches polarity at a time equal to or less than one gate line time (such as for example, one half of the first gate time) after a frame has ended. The manner in which this is accomplished, may be ascertained by reference to the following description.

Figure 5:
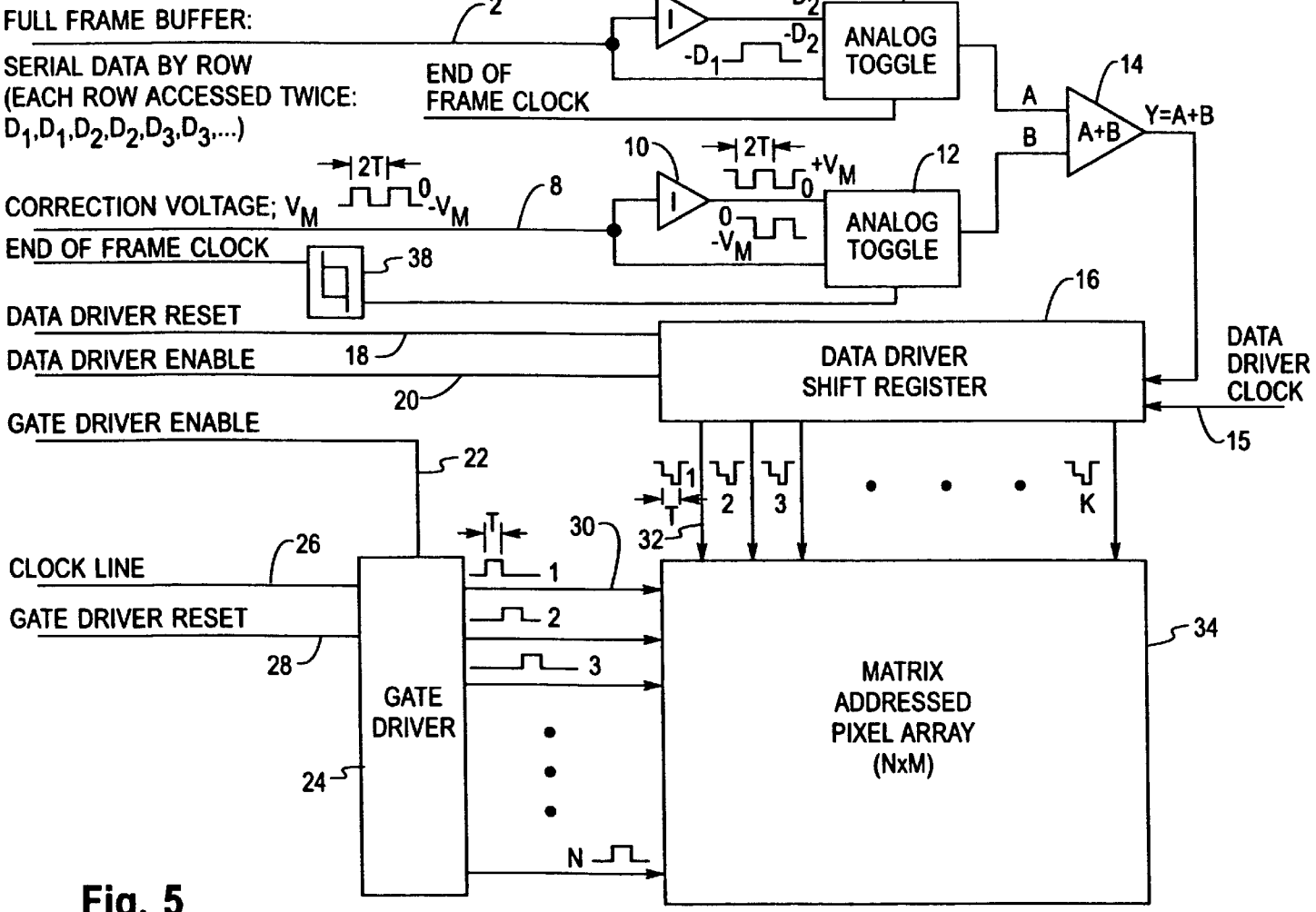
FIG. 5 is a block diagram of a circuit for implementing the invention in accordance with FIG. 4*a* to FIG. 4*f*.

Referring to FIG. 5, a block diagram very similar to that of FIG. 3 is used. The serial data clock input to analog toggle 4 is replaced by an end of frame clock, since the polarity of the data signal is changed only once each frame, as explained above. Further, analog toggle 12 is also controlled by the end of frame clock, but that signal is delayed by a delay circuit 38 which may be, for example, a one shot or monostable multivibrator. Generally, the delay time provided by delay circuit 38 will be constant or fixed for a given display design. However, it may be optimized for each different design. For example, for a display of high resolution, where the gate or line times are rather short, the delay time provided by delay circuit 38 should be as small a fraction of the line time as is practical for compensation to occur.

An advantage of the present invention, as described above with respect to FIG. 2*a* to FIG. 2*f* and FIG. 4*a* to FIG. 4*f* is that compensation can be provided for any data gray level polarity pattern or frame polarity inversion scheme, such as frame inversion, gate line inversion, data line inversion, and gate line polarity inversion with data line polarity inversion.

Figures 6A, 6B, 6C, 6D, 6E, 6F:
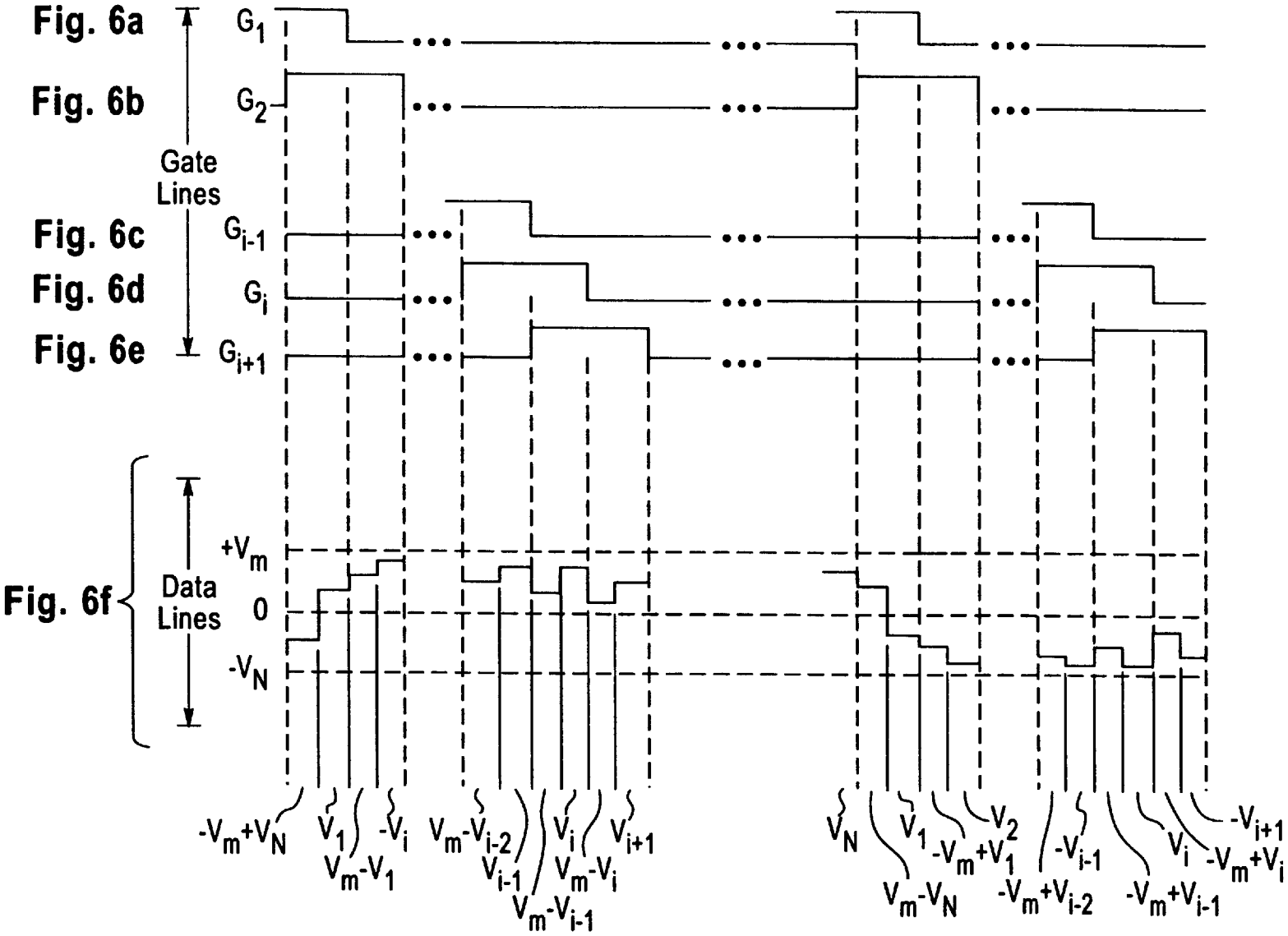
FIG. 6*a* to FIG. 6*f* represent timing diagrams for implementing yet another embodiment of the method according to the invention.

A third embodiment of the invention is illustrated with respect to the waveforms of FIG. 6*a* to FIG. 6*f*. The principles of operation of this embodiment of the invention are similar to those of FIG. 4, except that a particular problem is addressed. If a display requires more charging time than a gate line time due to for example, gate line delay problems, low TFT on current, etc., it is expedient to precharge one or more line times ahead of the gate time for which the data is provided. The embodiment of the invention illustrated in FIG. 4*a* to FIG. 4*f* can be modified so that crosstalk elimination and n-line precharge are both provided. For example, as shown in FIG. 6*a* to FIG. 6*c* each gate line is turned on for two gate line time periods. The polarity of the data voltage is alternated for each frame. The expressions for the voltages applied and the analysis for computing the RMS voltage at the ith row position are identical to that set forth above with respect to FIG. 4*a* to FIG. 4*f*.

The embodiment of the invention illustrated in FIG. 6*a* to 6*f* provides the advantages of the entire line time being utilized to charge pixels, the data voltage swing being only half of that of the embodiment of the invention FIG. 2*a* to FIG. 2*f*, and precharging n gate lines ahead.

While in the illustrated embodiment the gate line is turned on for two gate line times, in general it is turned on for n gate line times, where n is equal to or greater than one. Preferably n is an integer this is not essential.

Figure 7:
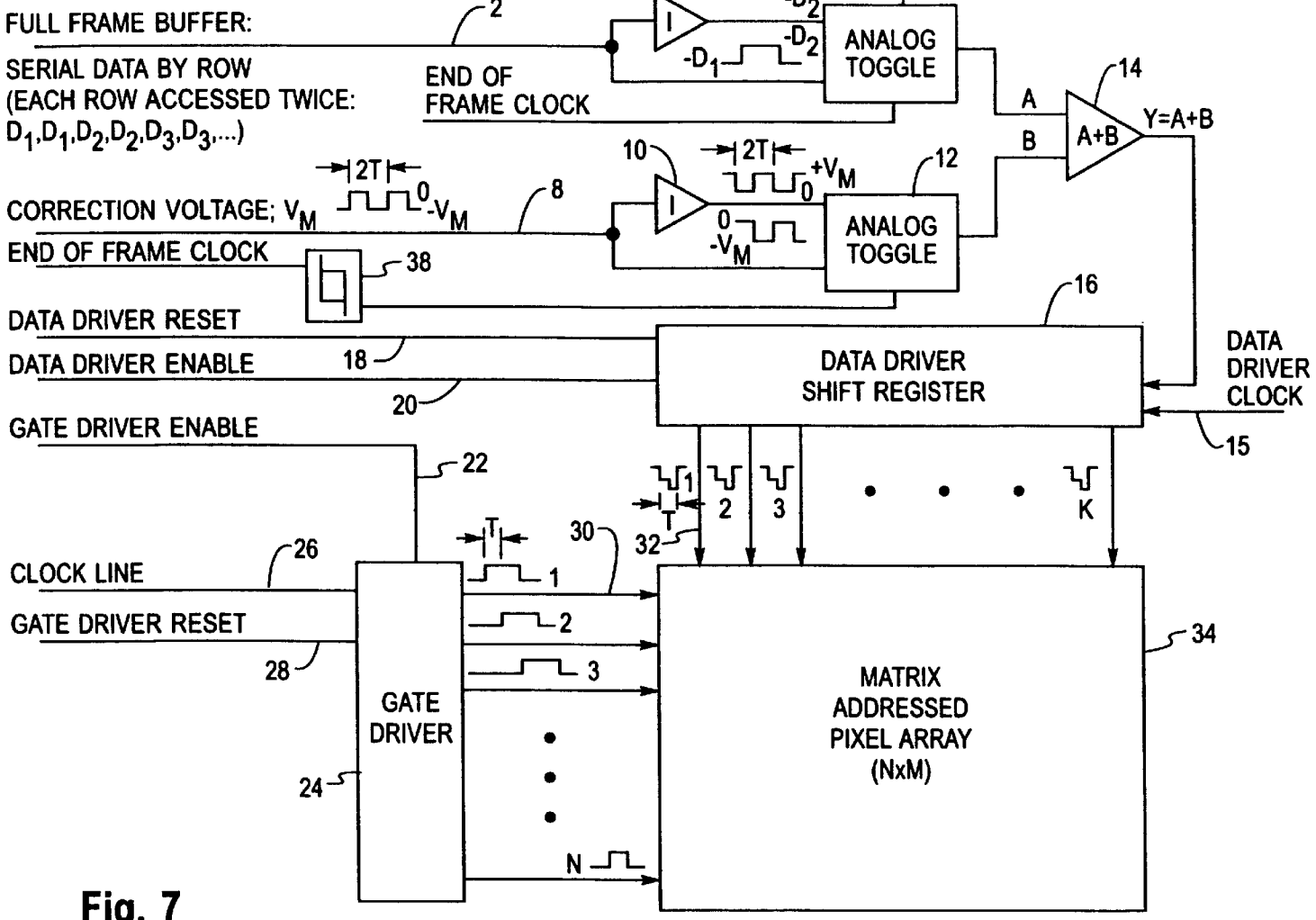
FIG. 7 is a block diagram of a circuit for implementing the invention in accordance with FIG. 6*a* to FIG. 6*f*.

Referring to FIG. 7, a block diagram of the circuit for providing the waveforms used by the embodiment of FIG. 6*a* to FIG. 6*f* is illustrated. It is very similar to that of FIG. 5, except that the gate driver 24*a* supplies gate pulses which overlap in time and are wider than one gate line time in width. This manner of driving is now being utilized for certain applications, and gate drivers of this kind are now well known in the art. With the use of such drivers, the gate pulses are conveniently n gate times in duration, where n is an integer, but as noted above, this is not required to practice the invention.

While the invention has been particularly shown and described with respect to a preferred embodiment thereof, it will be understood by those skilled in the art that changes in form and details may be made therein without departing from the scope and spirit of the invention.

We claim:

1. In an active matrix liquid crystal display including a plurality of sequentially excited gate lines and a plurality of data lines for exciting display elements of said liquid crystal display, a method for eliminating crosstalk between display elements comprising the step of:

starting a first gate time with a first gate line signal on to gate on certain display elements in a given frame to be displayed on said display at a time before a change in polarity of data signals and maintaining the same polarity of the data signals for a remainder of said frame; and precharging the certain display elements, while the first gate line signal is on, to a first data signal level with a compensation level, which compensation level varies as a function of a previous data signal level for a previously activated gate line.

2. The method of claim 1 wherein after said precharging but while the gate line signal is still on, the data line changes to an intended data signal level without the compensation level.

3. The method of claim 1 wherein said precharging occurs for a duration of substantially one half of the gate period.

4. In an active matrix liquid crystal display, including a plurality of sequentially excite gate lines and a plurality of data lines for exciting display elements of said liquid crystal display, a method for eliminating crosstalk between display elements, comprising the steps of:

alternating the polarity of the data voltage supplied to the data lines for every successive frame;

precharging the display elements with a compensation voltage that varies in accordance to the value of previous data to compensate for the previous data during a first portion of a line time while the gate line signal for those display element is on; and charging the display elements to a final voltage during at least a portion of the remainder of the line time while said gate line signal is still on said final voltage being representative of gray scale.

5. A method for reducing crosstalk in a display comprised of a matrix of thin film transistor liquid crystal display cells, each cell being defined by the intersection of one of a first plurality of data lines extending in a first direction and one of a second plurality of gate lines extending in a second direction which is at an angle to said first direction, with a given cell being turned on in response to the data line and the gate line that intersect at the cell having a data signal and a gating signal, respectively, applied thereto, said method comprising the steps of:

applying a gate signal to successive gate lines for at least a gate line period;

applying to said data lines a data signal voltage equal to a crosstalk compensation voltage for a previous data signal level during a first portion of a current gate signal period while the gate signal for said data lines is on;

and applying to said data liens while the gate signal is still on a voltage equal to a current data signal voltage for said current gate signal period to said data liens for a remainder of said current gate signal period; said current data signal voltage being representative of gray scale.

6. The method of claim 5, wherein said first portion of said current gate signal period has a duration of substantially one half the gate signal period.

7. IN a display comprised of a matrix of thin film transistor/liquid crystal display cells, each cell being defined by the intersection of one of a first plurality of data lines extending in a first direction and one of a second plurality of gate lines extending in a second direction which is at an angle to said first direction, with a given cell being turned on in response to the data line and the gate line that intersect at the cell having a data signal and a gating signal, respectively, applied thereto, the combination comprising:

gate signal means for applying a gate signal to successive gate lines for at least a gate line period; and data signal means for applying to said data lines while the gate signal is on for those lines a data signal equal to a crosstalk compensative voltage for a previous gate signal period during a first portion of a current gate signal period, and for applying a voltage equal to a current data signal voltage for said current gate signal period to said data lines while the gate signal is on for to those lines for a remainder of said current gate signal period; said current data signal voltage being representative of gray scale.

8. The display of claim 7 wherein said data signal means comprises:

first inverting means for inverting the data signal to produce an inverted data signal; and first alternating means for applying one of the data signal and the inverted data signal alternately to said data lines during successive frames of data displayed on said display.

9. The display of claim 8 wherein said data signal means further comprises:

a compensation signal source for supplying said compensation signal.

10. The display of claim 9 wherein said compensation signal source comprises:

second inverting means for inverting said compensation signal to produce an inverted compensation signal; and second alternating means for applying one of the compensation signal and the inverted compensation signal to said data lines during successive frames of data displayed on said display.

11. The display of claim 10 further comprising summing means for summing an output of said first alternating means and an output of said second alternating means to produce said data signal applied to said data lines.

12. The display of claim 7 wherein said first portion of said current gate signal period has a duration of substantially one half of that of said current gate signal period.

13. The display of claim 7 wherein said gate signal means starts to apply said gate signal for a time before said current gate line period.

14. The display of claim 7 wherein said gate signal means is applied for a period of time equal to an integer multiple of a gate line period.

* * * * *